United States Patent [19]

Pella

[11] Patent Number: 4,991,469

[45] Date of Patent: Feb. 12, 1991

[54] VALVE HANDWHEEL WRENCH

[76] Inventor: Paul D. Pella, 1206 Emerald Dr., Singer Island, Fla. 33404

[21] Appl. No.: 465,054

[22] Filed: Jan. 16, 1990

[51] Int. Cl.[5] ..... B25B 13/48

[52] U.S. Cl. ..... 81/176.2; 81/176.1; 81/176.15

[58] Field of Search ..... 81/176.2, 176.1, 176.15

[56] References Cited

U.S. PATENT DOCUMENTS

| | | | |
|---|---|---|---|
| 2,086,722 | 7/1937 | Matuella | 81/176.2 |
| 2,357,562 | 9/1944 | Thom et al. | 81/176.2 |
| 2,539,262 | 1/1951 | Moore | 81/90 |
| 2,682,189 | 6/1954 | Bergman | 81/90 |
| 3,482,476 | 12/1969 | Tanksley | 81/3.42 |
| 3,641,846 | 2/1972 | Prial | 81/176.2 |
| 4,715,252 | 12/1987 | Pella | 81/176 |
| 4,848,194 | 7/1989 | Santorineos | 81/176.2 |

FOREIGN PATENT DOCUMENTS

| | | | |
|---|---|---|---|
| 0349760 | 6/1931 | United Kingdom | 81/176.2 |

*Primary Examiner*—Frederick R. Schmidt
*Assistant Examiner*—Lawrence Cruz
*Attorney, Agent, or Firm*—Alvin S. Blum

[57] ABSTRACT

A device for safely rotating the handwheel of hard-to-turn valves has an elongate handle terminating in a fixed wheel-rim-engaging jaw. A movable wheel-engaging jaw is pivotally attached to the handle behind the fixed jaw. When the movable jaw is applied to the inner surface of the handwheel rim and the fixed jaw is applied to the outer surface of the rim, turning force on the handle forces the two jaws together by a leveraged force to enhance gripping of the rim while turning the wheel. Protuberances on the movable jaw enhance gripping the wheel rim and spoke.

14 Claims, 1 Drawing Sheet

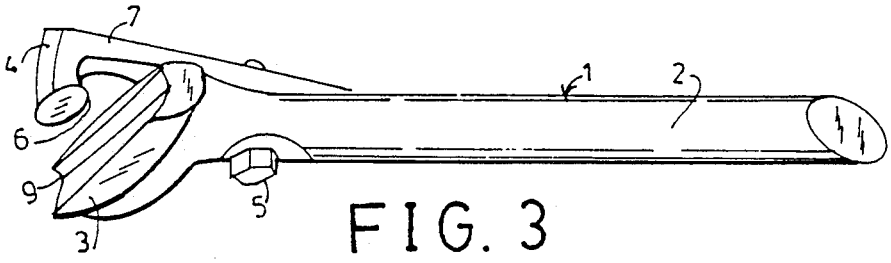
FIG. 3
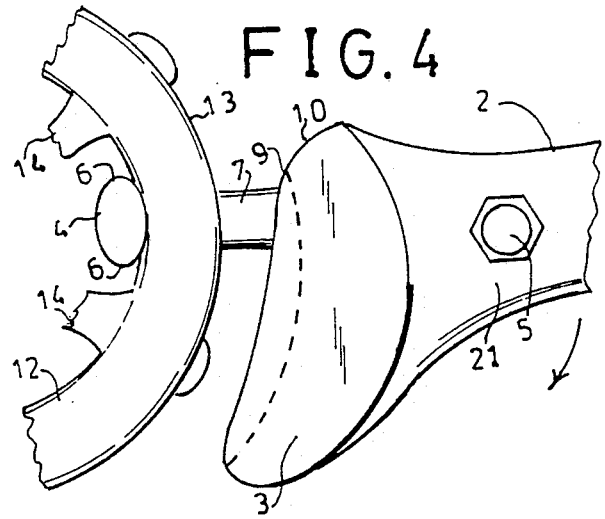
FIG. 4
FIG. 1
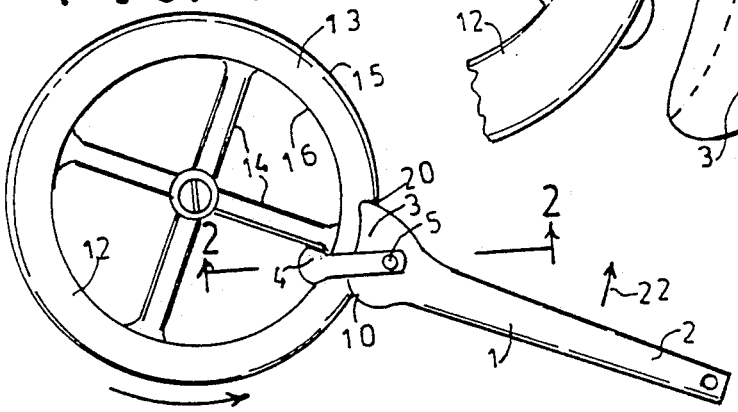
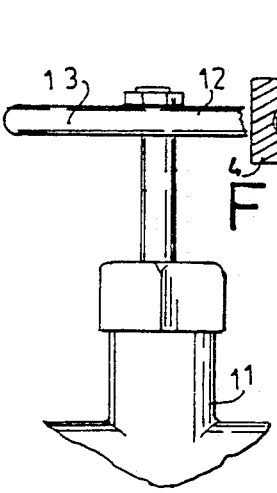
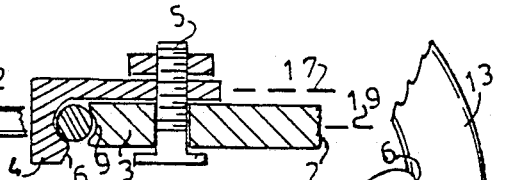
FIG. 2
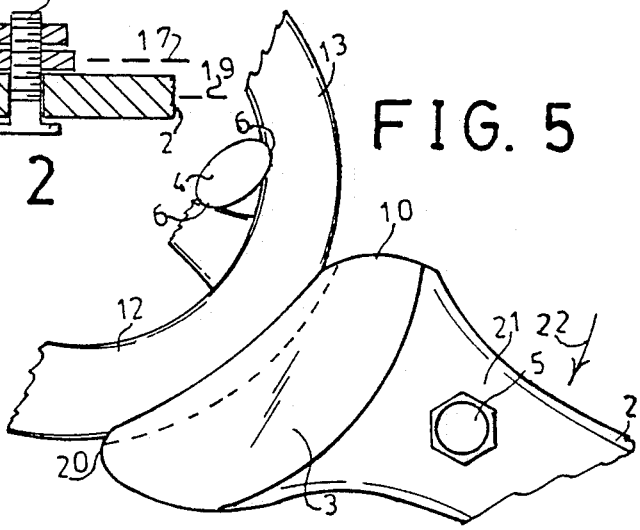
FIG. 5

VALVE HANDWHEEL WRENCH

BACKGROUND OF THE INVENTION

The present invention relates to wrenches and more particularly to wrenches providing increased leverage for turning the handwheels of valves.

In certain industries and occupations it is sometimes necessary to open and close valves by means of a handwheel attached to the valve stem. When the valve is large and when the valve does not turn as freely as designed, the handwheel may not provide enough leverage to operate the valve. Various methods of aiding this process have been provided. U.S. Pat. No. 4,715,252 issued to A. Pella discloses a one-piece wrench that engages the outside of the rim and a spoke of the handwheel while force is applied by an extended handle. U.S. Pat. No. 2,086,722 issued to C. J. Matuella teaches a wrench with three projections to engage the rim. U.S. Pat. No. 2,539,262 issued to A. H. Moore describes a wrench whose two members alternately wrap under and over the wheel rim. U.S. Pat. No. 2,682,189 issued to W. K. Bergman teaches a similar device. U.S. Pat. No. 3,482,476 issued to M. M. Tanksley discloses a wrench with a first jaw movably connected to a second jaw in a sliding, translatory relationship urged together by a spring.

The prior art devices have not resolved certain problems. It is most important that the wrench grip tightly, especially when maximum force is applied to the handle, because that force is often applied by pulling the handle toward the user at face level. If the jaws lose their grip, the handle often smashes the face of the worker, often causing dental injuries.

The wrench must grip both large and small valves and work effectively in turning both clockwise and counterclockwise.

SUMMARY OF THE INVENTION

It is accordingly an object of the invention to provide a wrench that will grip both small and large handwheels for both clockwise and counterclockwise rotation. It is yet another object that the wrench grip more tightly as more force is applied.

The wrench of the invention comprises an elongate handle with a fixed jaw at one end for engaging the outer edge of the handwheel. Pivotally attached to an intermediate portion of the handle is a movable jaw arranged to grip the inner edge of the rim at the same time. The movable jaw may also engage a spoke of the wheel at the same time. When the handle is moved in a turning motion, the two jaws are forced together providing enhanced gripping to prevent slipping of the wrench on the wheel. The greater the force on the handle, the more tightly the two jaws are forced together so that there is less danger of the wrench slipping.

These and other objects, advantages and features of the invention will become more apparent when the detailed description is studied in conjunction with the drawings.

BRIEF DESCRIPTION OF THE DRAWINGS

FIG. 1 is a plan view of a wrench of the invention in use on a valve.

FIG. 2 is a partial sectional view through line 2—2 of FIG. 1.

FIG. 3 is a perspective view of the wrench.

FIG. 4 is a partial plan view of the wrench being installed on a handwheel.

FIG. 5 is a partial plan view as in FIG. 4 after turning force is applied to the handle showing how the jaws are forced together.

DETAILED DESCRIPTION OF PREFERRED EMBODIMENT

Referring now first to FIGS. 1, 2 and 3, a wrench 1 of the invention is in operation, applied to handwheel 12 of valve 11. The handle 2 is being pushed in a counterclockwise direction to turn the valve. On conventional valves, this opens the valve. A fixed jaw or rim grip 3 at the end of the handle has a groove 9 in its face that engages the outer surface 15 of the rim and the curvature of jaw 3 is constructed to approximate the usual curvature of the rim. A movable second jaw 4 engages the inner surface 16 of the handwheel rim and the spoke 14. The movable jaw 4 is connected to connecting member 7 that is pivotally connected by pivot 5 to the intermediate portion 21 in such fashion that as handle 2 and jaws 3 and 4 move in a first plane 19, connecting member 7 moves in a second plane 17 parallel to the first plane and spaced apart sufficiently to permit the handwheel to fit between the two jaws without interference. As the handle is rotated, as indicated by arrow 22, the end 20 of jaw 3 acts as a fulcrum where it impinges on the rim outer surface 15, pulling pin 5 away from the rim and thereby forcing movable jaw 4 against inner surface 16 of the rim with such force that it grips tenaciously and the greater the force on handle 2, the greater the gripping with the mechanical advantage of the ratio of the two lever arms. This is effective for gripping the rim at any point. In a crowded pipe array, it may not be possible to grip the rim at any desired location. When access to a spoke 14 is available, the movable jaw 4 may be moved to its juncture with the rim for even greater effective non-slip gripping and for applying force at a stronger region of the wheel to avoid breakage. The free end of the movable jaw 4 has a protuberance 6 that engages another surface on the rim and spoke to further enhance gripping of the wheel.

The mechanism of operation of the device is shown in FIGS. 4 and 5, where the wrench is installed as at 4, and as handle 2 is rotated to close the valve, jaw 4 is moved to spoke 14 and forced outward and against the spoke by the lever arm. In this mode the connecting member 7 is underneath the rim 13, whereas it is over the rim in FIG. 1 for counterclockwise rotation. The fixed jaw 3 has a reverse curve 10 at the end opposite the fulcrum end 20 for easier installation on large size handwheels. The engaging faces of the jaws may contain teeth or a high friction surface for enhanced gripping. The device may be constructed of a variety of materials such as plastics, steel or magnesium-aluminum alloy.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A valve wrench for turning the handwheel of a valve of the type having a wheel with a rim and radial spokes, said wrench comprising:

(A) an elongate handle member having a long axis lying in a first plane, said handle member having a free end, an intermediate portion and a wheel grasping end;

(B) a connecting member pivotally affixed to said intermediate portion by a pivot pin arranged substantially at right angles to said long axis;

(C) a fixed, arcuate rim grip extending from said wheel grasping end in said first plane, said rim grip having a radius of curvature which approximates the radius of curvature of said rim, said rim grip having an extended, arcuate rim-engaging face, said face having an arcuate groove therein for enhanced grasping of the outer perimeter of said rim;

(D) a movable jaw means for gripping an interior surface of said rim and for gripping a spoke of said wheel, said jaw means having a central portion interposed between a first side portion and a second side portion;

(E) said central portion arranged to appose said groove in said fixed rim grip for engaging an inside surface of said rim and a surface of said spoke;

(F) said first side portion having at least one lateral protuberance extending outwardly for engaging said rim and said spoke on a surface other than that engaged by said central portion for enhanced, slip-proof grasping; and (G) said second side portion rigidly connected to said connecting member, whereby said pivot pin restricts said connecting member motion to pivoting in a second plane parallel to said first plane and displaced therefrom a distance great enough to enable said movable jaw means to move in a fixed arc whose center corresponds to the position of said pivot pin and to forcefully engage the inner surface of said rim and spoke of said wheel while said fixed grip forcefully engages the outer surface of said rim when said handle is moved through said first plane in a wheel-turning motion.

2. The wrench according to claim 1, in which said rim-engaging face of said rim grip, and said groove therein, have a substantially sigmoid shape for easier fitting on a wheel.

3. The wrench according to claim 1, further comprising teeth on said rim grip and said movable jaw means for enhanced grasping.

4. The wrench according to claim 1, further comprising a high friction surface on said rim grip and said movable jaw means for enhanced grasping.

5. The wrench according to claim 1 constructed of steel.

6. The wrench according to claim 1 constructed of an aluminum-magnesium alloy.

7. The wrench according to claim 1 constructed at least in part of plastic material.

8. A valve wrench for turning the handwheel of a valve of the type having a wheel with a rim and radial spokes, said wrench comprising:

(A) an elongate handle member having a long axis lying in a first plane, said handle member having a free end, an intermediate portion and a wheel grasping end;

(B) a connecting member pivotally affixed to said intermediate portion by a pivot pin arranged substantially at right angles to said long axis;

(C) a fixed, arcuate rim grip extending from said wheel grasping end in said first plane, said rim grip having a radius of curvature which approximates the radius of curvature of said rim, said rim grip having an extended, arcuate rim-engaging face, said face having an arcuate groove therein for enhanced grasping of the outer perimeter of said rim;

(D) a movable jaw means for gripping an interior surface of said rim and for gripping a spoke of said wheel, said jaw means having a central portion interposed between a first side portion and a second side portion;

(E) said central portion arranged to appose said groove in said fixed rim grip for engaging as inside surface of said rim and a surface of said spoke;

(F) said first side portion extending outwardly from said central portion; and (G) said second side portion rigidly connected to said connecting member, whereby said pivot pin restricts said connecting member motion to pivoting in a second plane parallel to said first plane and displaced therefrom a distance great enough to enable said movable jaw means to move in a fixed arc whose center corresponds to the position of said pivot pin and to forcefully engage the inner surface of said rim and spoke of said wheel while said fixed grip forcefully engages the outer surface of the rim when said handle is moved through said first plane in a wheel turning motion.

9. The wrench according to claim 8, in which said rim-engaging face of said rim grip, and said groove therein, have a substantially sigmoid shape for easier fitting on a wheel.

10. The wrench according to claim 8, further comprising teeth on said rim grip and said movable jaw means for enhanced grasping.

11. The wrench according to claim 8, further comprising a high friction surface on said rim grip and said movable jaw means for enhanced grasping.

12. The wrench according to claim 8 constructed of steel.

13. The wrench according to claim 8 constructed of an aluminum-magnesium alloy.

14. The wrench according to claim 8 constructed at least in part of plastic material.

* * * * *